US010702977B2

(12) United States Patent
Dahl et al.

(10) Patent No.: US 10,702,977 B2
(45) Date of Patent: Jul. 7, 2020

(54) PINCH-OFF PLIERS

(71) Applicant: A & E Incorporated, Racine, WI (US)

(72) Inventors: Vincent Dahl, Kenosha, WI (US); Michael Hughes, Racine, WI (US)

(73) Assignee: A & E INCORPORATED, Racine, WI (US)

( * ) Notice: Subject to any disclaimer, the term of this patent is extended or adjusted under 35 U.S.C. 154(b) by 149 days.

(21) Appl. No.: 15/479,668

(22) Filed: Apr. 5, 2017

(65) Prior Publication Data

US 2018/0099384 A1 Apr. 12, 2018

Related U.S. Application Data

(63) Continuation of application No. 29/580,357, filed on Oct. 7, 2016, now Pat. No. Des. 809,888.

(51) Int. Cl.

| | |
|---|---|
| ***B25B 7/14*** | (2006.01) |
| ***B25G 1/06*** | (2006.01) |
| ***B25B 7/02*** | (2006.01) |
| ***B25G 1/10*** | (2006.01) |
| ***B25B 7/04*** | (2006.01) |

(52) U.S. Cl.

CPC ..... *B25B 7/14* (2013.01); *B25B 7/02* (2013.01); *B25B 7/04* (2013.01); *B25G 1/063* (2013.01); *B25G 1/102* (2013.01)

(58) Field of Classification Search

CPC .... B25B 7/02; B25B 7/04; B25B 7/14; B25G 1/063; B25G 1/102

USPC ..... 81/342

See application file for complete search history.

(56) References Cited

U.S. PATENT DOCUMENTS

| | | | | |
|---|---|---|---|---|
| 2,483,380 | A | | 9/1949 | Duffy |
| 3,503,114 | A | | 3/1970 | Stanton |
| 3,762,019 | A | | 10/1973 | Epstein |
| D273,455 | S | | 4/1984 | Teitelbaum |
| D276,880 | S | * | 12/1984 | Tozaburo ..... D8/52 |
| 4,572,179 | A | | 2/1986 | Teitelbaum |
| 4,793,224 | A | | 12/1988 | Huang |
| 5,007,313 | A | | 4/1991 | Jeromson, Jr. et al. |

(Continued)

FOREIGN PATENT DOCUMENTS

WO WO 2011/090983 1/2011

OTHER PUBLICATIONS

Redline Detection, LLC; Rapid Shift Internal to External Circlip Pliers (Part No. RDL95-0200) http://www.olct.co/redline-detection/snap-ring-pliers-12-piece-set#, dated May 8, 2014.

*Primary Examiner* — Hadi Shakeri

(74) *Attorney, Agent, or Firm* — Ryan Kromholz & Manion, S.C.

(57) ABSTRACT

A pinch-off pliers possessing a canted orientation along the length. The pinch-off pliers has a first clamping unit, a second clamping unit, and an axial mechanism. The pinch-off pliers positioned along a first axis and a second axis, where the first axis is not parallel to the second axis. An intersection of the first axis and the second axis along the length of the pinch-off pliers creates a canting angle theta in the pinch-off pliers at the intersection. An intersection of a first plane and a third plane creates a second canting angle omega when having the pinch-off pliers positioned along the first axis and an intersecting fourth axis.

7 Claims, 3 Drawing Sheets

(56) References Cited

U.S. PATENT DOCUMENTS

| | | | | | |
|---|---|---|---|---|---|
| 5,022,291 | A * | 6/1991 | McBain | B25B 7/02 | 81/185.2 |
| 5,065,650 | A | 11/1991 | Anderson | | |
| 5,174,177 | A | 12/1992 | Jeromson, Jr. | | |
| 5,826,467 | A | 10/1998 | Huang | | |
| 5,865,075 | A | 2/1999 | Medved | | |
| 6,081,952 | A * | 7/2000 | Haxton | B25B 7/02 | 7/107 |
| D428,785 | S | 8/2000 | Jimenez | | |
| 6,145,417 | A | 11/2000 | Bates | | |
| 6,257,105 | B1 | 7/2001 | Lin | | |
| 6,378,403 | B1 | 4/2002 | Bates | | |
| 6,470,774 | B2 | 10/2002 | Chang | | |
| 6,662,690 | B1 * | 12/2003 | Ploeger | B25B 7/12 | 81/318 |
| 6,983,677 | B1 | 1/2006 | Engel | | |
| 7,156,004 | B1 * | 1/2007 | Whitehead | B25B 7/02 | 81/420 |
| 7,448,301 | B1 | 11/2008 | Cronin | | |
| D650,647 | S * | 12/2011 | Groten | D8/52 | |
| 8,347,471 | B2 | 1/2013 | Wang | | |
| 9,003,930 | B2 | 4/2015 | Mitchell | | |
| 9,475,177 | B1 * | 10/2016 | Lazarov | B25B 7/10 | |
| D775,503 | S | 1/2017 | Ludtke | | |
| D775,916 | S | 1/2017 | Ludtke | | |
| D775,917 | S | 1/2017 | Wu | | |
| 2004/0089117 | A1 * | 5/2004 | Hsien | B25B 7/00 | 81/424 |
| 2011/0214538 | A1 | 9/2011 | Huang | | |
| 2012/0010032 | A1 * | 1/2012 | Yang | A63B 51/02 | 473/553 |
| 2015/0298310 | A1 | 10/2015 | Cronin | | |

* cited by examiner

PINCH-OFF PLIERS

RELATED APPLICATIONS

This application is a continuation of co-pending U.S. Design patent application Ser. No. 29/580,357, filed 7 Oct. 2016.

BACKGROUND OF THE INVENTION

Pliers, specifically pinch-off pliers are well known in the art. Pinch-off pliers may be used in a variety of industries and applications where the containment or restriction of fluid flow in a flexible tube is desired or required. Pinch-off pliers may be used in automotive applications to restrict the flow of coolant or other fluids in flexible tubes. Pinch-off pliers may be employed in machine applications. Pinch-off pliers may be applied on a variety of flexible tubing including vacuum lines, fuel lines and coolant lines.

The linear orientation of the prior art pliers provide for applications where open access to a flexible tube is available. However, the linear orientation of the prior art becomes restrictive if not ineffective where the tube to be pinched is located in a confined space. In some orientations during use, the prior art pinch-off pliers ill not be able to effectively pinch the tube due to the location of the tube in a confined space and/or reach the flexible tube. Accordingly, the art of pinch-off pliers would benefit from are more reliably engaged pinch-off pliers which may be used for hose applications in confined spaces.

SUMMARY OF THE INVENTION

The present invention relates to a more reliably engaged pinch-off pliers which may be used for hose applications in confined spaces. A pinch-off pliers may comprise a first clamping unit, a second clamping unit, and an axial mechanism. The first clamping unit may comprise a first unit handle portion, a first unit medial portion, a first unit front portion, and a first unit clamp portion. The first clamping unit may have the first unit medial portion between the first unit handle portion and the first unit front portion. The first clamping unit may be formed from at least one member, but preferably two members comprising a first member and a second member. The first member may incorporate the first unit handle portion and a first member medial portion. The second member may incorporate the first unit front portion, the first unit clamp portion, and a second member medial portion. The first member medial portion and the second member medial portion may be preferably mechanically in movable communication to form the first unit medial portion. The axial mechanism separates a handle section of the pinch-off pliers and a clamping section of the pinch-off pliers.

The first unit handle portion may be configured to be receivable within an operator's hand. The first unit handle portion may be configured to be ergonomically formed to reduce user hand strain and fatigue by coating the first member handle portion in a polymeric material as known in art and/or increasing the surface area in which the first unit handle portion contacts a user's hand.

The second clamping unit may comprise a second unit handle portion, a second unit medial portion, a second unit front portion, and a second unit clamp portion. The second clamping unit may have the second unit medial portion between the second unit handle portion and a second unit front portion. The second clamping unit may be formed from at least one, preferably one member.

The second unit handle portion may be configured to be received within an operator's hand. The second unit handle portion may be configured to be ergonomically formed to reduce user hand strain and fatigue. This can be accomplished by coating the second unit handle portion in a polymeric material as known in the art and/or increasing the surface area in which the second unit handle portion contacts a user's hand.

The first clamping unit and second clamping unit may be in mechanical communication at an axial mechanism. The axial mechanism may preferably comprise a first unit medial portion in mechanical communication with a second unit medial portion. An axis of rotation preferably may extend through the axial mechanism between the first clamping unit and the second clamping unit. Alternatively, the axial pin assembly may extend beyond only one or none of the axial mechanism sides, being a first side of the first unit medial portion or a second side of a second unit medial portion. The axial mechanism may preferably provide for movement of the first clamping unit and second clamping unit to produce a pinching action.

The axial mechanism may preferably incorporate a locking pin assembly. The locking pin assembly may preferably extends through a combination of a locking pin channel and locking pin assembly traveling channels, extending through a first side of the first unit medial portion to beyond a second side of the second unit medial portion. Alternatively, the locking pin assembly may extend beyond only one side of the axial mechanism, being the first side of the first unit medial portion or the second side of the second unit medial portion.

The first unit front portion may be preferably in fixed communication with the first unit medial portion at a first unit intersection along a first length $L_1$ of the first clamping unit. Alternatively, the first unit intersection may join the first unit medial portion and the first unit front portion in various geometric orientations. The first unit front portion may preferably extend from the first unit intersection ending at a first tip of the first clamping unit. A first unit clamp portion may be in mechanical, preferably pivotal communication, with the first tip of the first clamping unit. Alternatively, the first unit clamp portion may be in non-pivotal, mechanical communication with the first tip of the first clamping unit. The first unit clamp portion preferably may extend a second length $L_2$ along the first unit front portion. Alternatively, the first unit clamp portion may extend a second length $L_2$ traversing the first unit front portion.

A second unit front portion may be preferably in fixed communication with the second unit medial portion at a unit intersection along a first length $L_1$ of the second clamping unit. Alternatively, the second unit intersection may join the second unit medial portion and the second unit front portion in various geometric orientations. The second unit front portion preferably may extend from the second unit intersection ending at a second tip of the second clamping unit. The second unit clamp portion may be in mechanical, preferably pivotal communication, with the second tip of the second clamping unit. Alternatively, the second unit clamp portion may be in non-pivotal, mechanical communication with the second tip of the second clamping unit. The second unit clamp portion may extend a third length $L_3$ along the second unit front portion. Alternatively, the second unit clamp portion extends a third length $L_3$ traversing the second unit front portion. The third length $L_3$ of the second unit clamp portion may be greater than, less than, or preferably equal to the second length $L_2$ of the first unit clamp portion.

At least a portion of the first clamping unit and at least a portion of the second clamping unit follow along a first axis. Regarding the first clamping unit, a combination of the first unit handle portion and the first unit medial portion, up to and including the axis of rotation, may preferably follow along the first axis. Regarding the second clamping unit, a combination of the second unit handle portion and the second unit medial portion, up to and including the axis of rotation, may preferably follow along the first axis.

At least a portion of the first clamping unit and at least a portion of the second clamping unit may follow along a second axis. Regarding the first clamping unit, a combination of the first unit medial portion and first unit front portion, anterior to the axis of rotation, may preferably follow along the second axis. Regarding the second clamping unit, a combination of the second unit medial portion and second unit front portion, anterior to the axis of rotation, may preferably follow along the second axis.

An intersection of the first axis and the second axis forming a canting angle theta. Preferably the canting angle theta may extend towards to the second unit handle portion. Alternatively, the canting angle theta may extend towards the first unit handle portion. The canting angle theta may be preferably greater than zero degrees. The canting theta may be positioned along a first length $L_1$ of the pinch-off pliers. Preferably, the canting angle theta may be positioned along the clamping section. Alternatively, the canting angle theta may be positioned at any location along the first length $L_1$ of the pinch-off pliers.

In an alternative embodiment, the pinch-off pliers may defined by the canting angle theta in combination with a canting angle omega. A first plane and a second plane may intersect, and are perpendicular, along the first axis. The first axis may be contained in the first plane. At least a portion of the first clamping unit and at least a portion of the second clamping unit may follow along the first plane. Regarding the first clamping unit, a combination of the first unit handle portion and the first unit medial portion, up to and including the axis of rotation, may preferably follow along the first plane. Regarding the second clamping unit, a combination of the second unit handle portion and the second unit medial portion, up to and including the axis of rotation, may preferably follow along the first plane.

A third axis intersects the first axis at an intersection from the first side of the first clamping unit to the second side of the second clamping unit. The third axis may be perpendicular to the first axis and contained in the second plane. A fourth axis may intersect the first axis and the second plane at an intersection. At least a portion of the first clamping unit and at least a portion of the second clamping unit may follow along the fourth axis. Regarding the first clamping unit, a combination of the first unit medial portion and first unit front portion, anterior to the axis of rotation, may preferably follow along the fourth axis. Regarding the second clamping unit, a combination of the second unit medial portion and second unit front portion, anterior to the axis of rotation, may preferably follow along the fourth axis.

The intersection, which is one in the same with the intersection of the third axis and the first axis, of the first axis, second plane and the fourth axis forming the canting angle theta. The canting angle theta may be any angle greater than or less than zero degrees. Zero degrees for the canting angle theta is defined as the canting angle theta where the fourth axis is contained in the second plane. Preferably the canting angle theta extends towards the second unit handle portion. Alternatively, the canting angle theta may extend towards the first unit handle portion. The canting angle theta may be preferably greater than zero degrees. The canting angle theta may be positioned along a first length $L_1$ of the pinch-off pliers. Preferably, the canting angle theta may be positioned along the clamping section. Alternatively, the canting angle theta may be positioned at any location along the first length $L_1$ of the pinch-off pliers.

A fifth axis intersects, and is perpendicular to the first axis. The fifth axis being contained by the first plane. A third plane intersects the first plane at the fifth axis intersection. The fourth axis being contained in the third plane. The intersection of the first plane and the third plane forming the canting angle omega. The canting angle omega may be any angle greater than, equal to, or less than zero degrees. Zero degrees for the canting angle omega is defined as the canting angle omega where the third plane rests over or is parallel to the first plane. Preferably the canting angle omega extends along the first plane. Alternatively, the canting angle omega extends towards the first side of the first clamping unit. Alternatively, the canting angle omega extends towards the second side of the second clamping unit. The canting angle omega may be positioned along the first length $L_1$ of the pinch-off pliers. Preferably, the canting angle omega may be positioned along the clamping section. Alternatively, the canting angle omega may be positioned at any location along the first length $L_1$ of the pinch-off pliers.

An open area of the pinch-off pliers may be defined by the an area encompassed by at least one, preferably a portion of each, of the axial mechanism, the first unit front portion, the second unit front portion, the first unit clamp portion, and the second unit clamp portion. Alternatively, the open area may not be defined.

The pinch-off pliers invention may be applied as follows. An open access may be defined by two barriers. A first barrier may define a bottom of the open access. A second barrier defines a top of the open access. A cavity may exist beyond the open access. A hose may be positioned in the cavity such that the prior art pinch-off pliers could not be maneuvered to successfully contact the hose. The pinch-off pliers may be inserted into the open access in the direction of the hose. The pinch-off pliers possesses a canting angle theta, between the first axis and the second axis, which is not equal to zero degrees. The pinch-off pliers may be maneuvered to pinch the hose cross-section.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
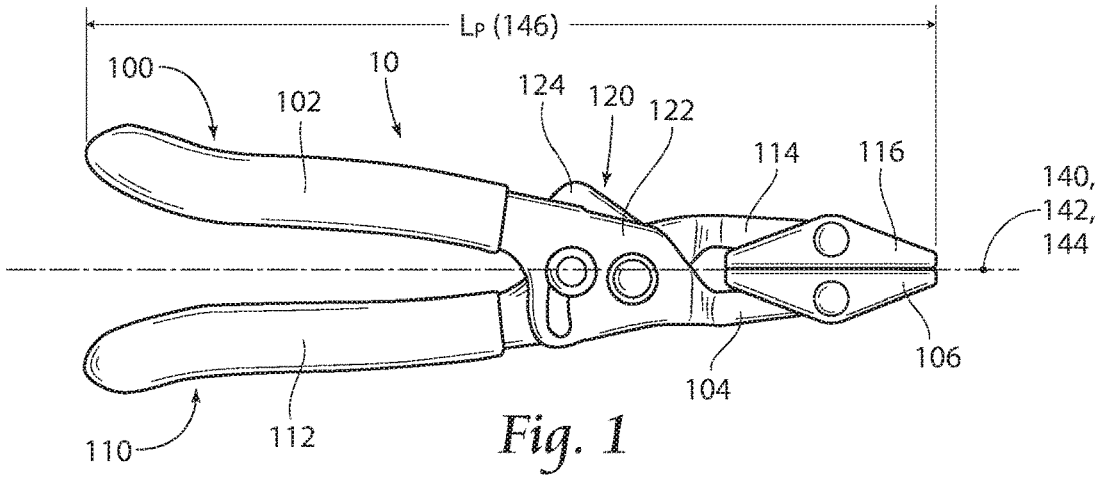
Fig. 1 PRIOR ART
FIG. 1 is a right side elevation view of prior art pinch-off pliers.
Figure 2:
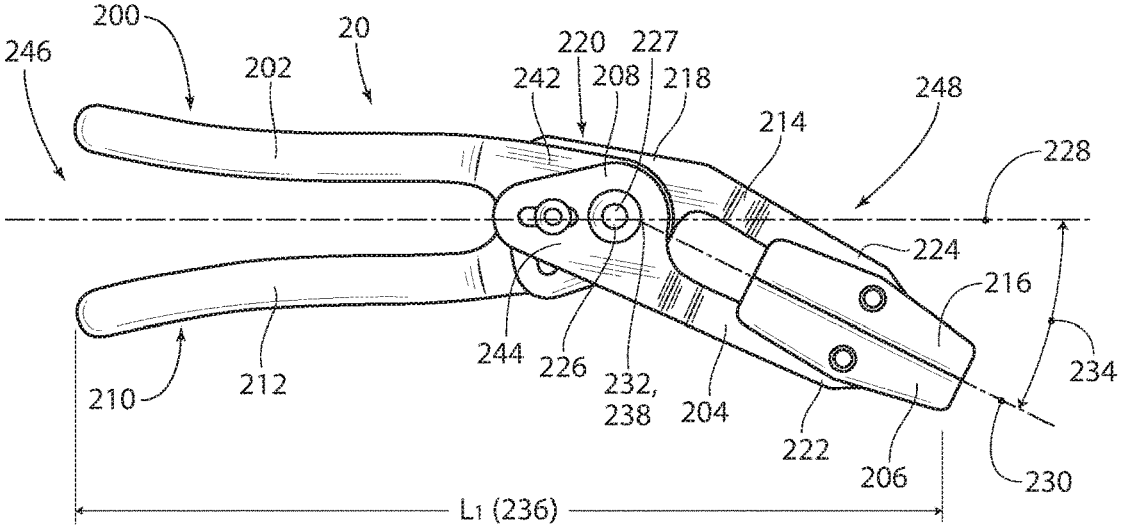
FIG. 2 is a right side elevation view of the pinch-off pliers of the invention.
Figure 3:
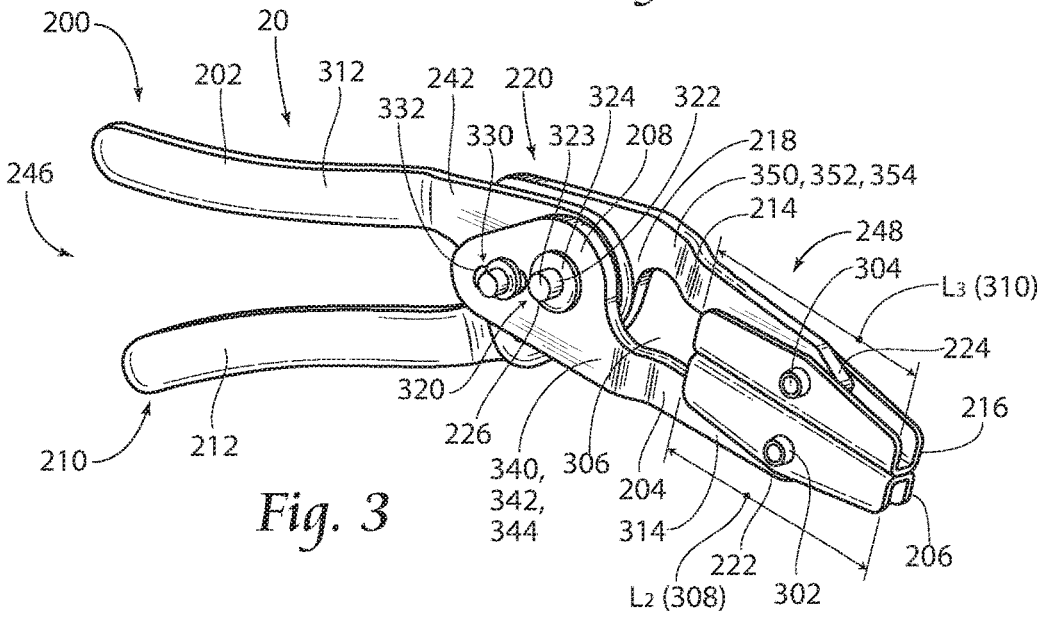
FIG. 3 is a perspective view of the pinch-off pliers of the invention.
Figure 4:
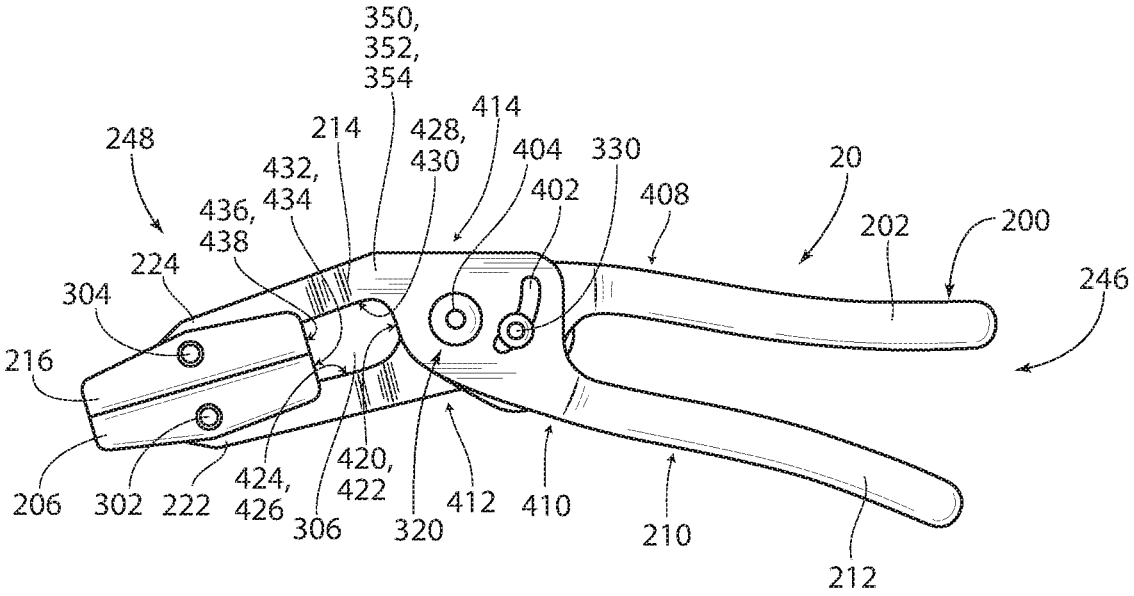
FIG. 4 is a left side elevation view of the pinch-off pliers of the invention.
Figure 5:
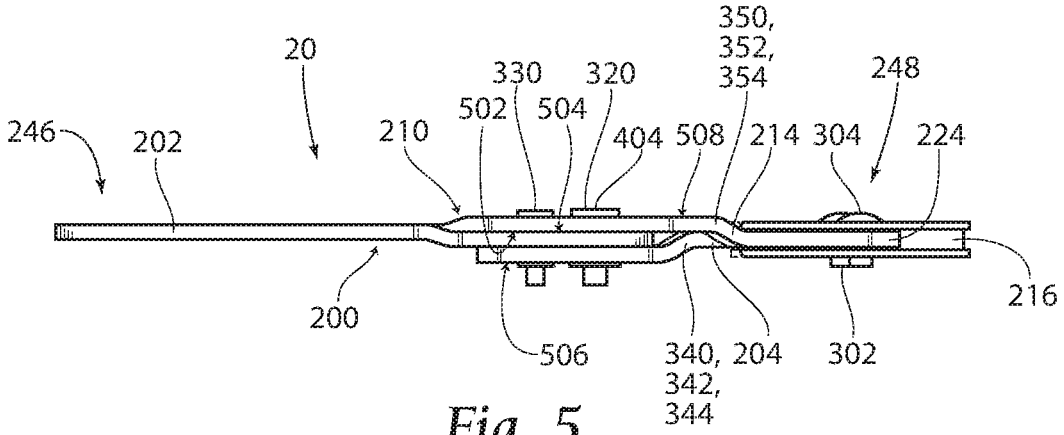
FIG. 5 is a top plan view of the pinch-off pliers of the invention.
Figure 6:
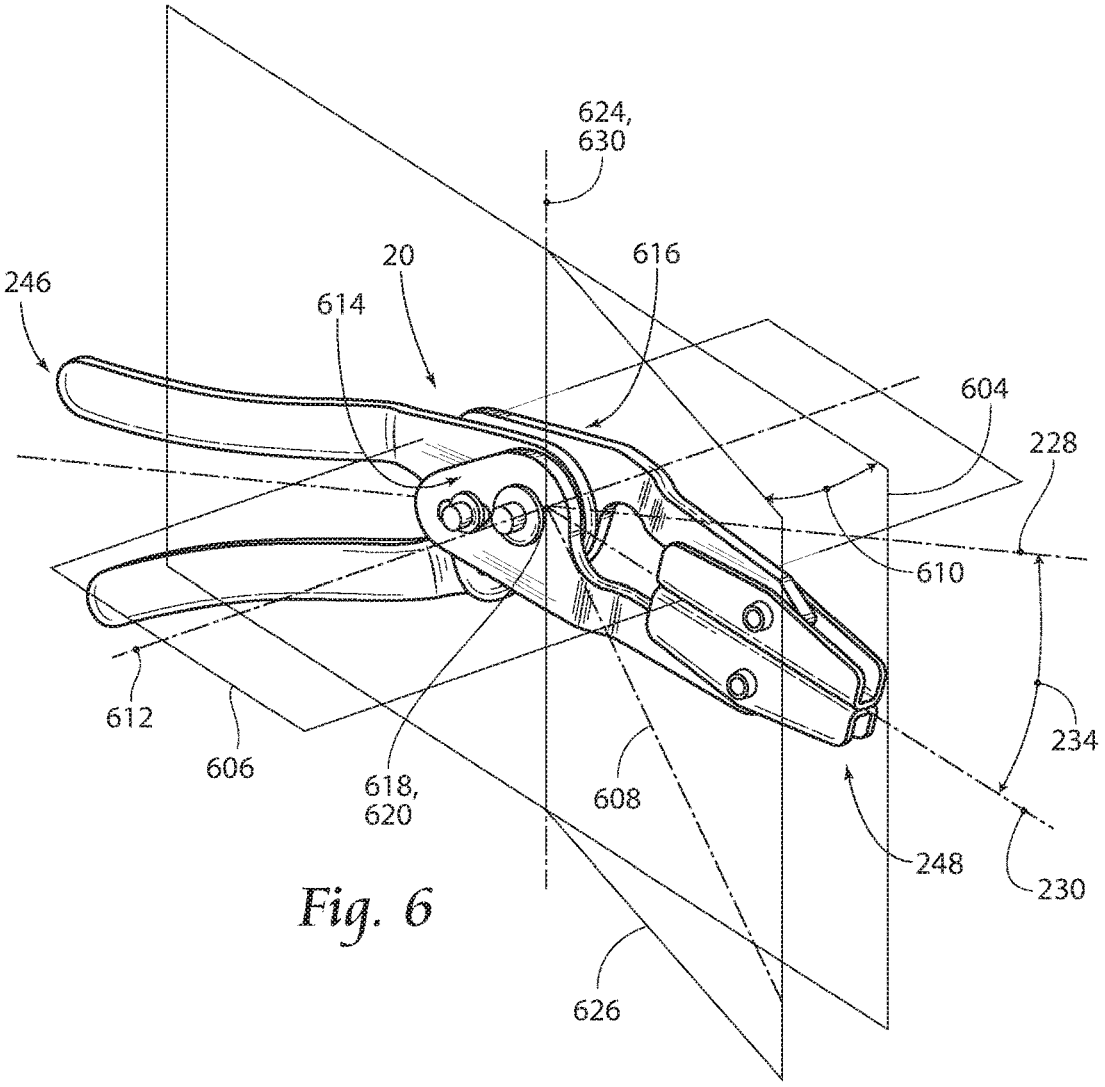
FIG. 6 in a perspective view of an alternate embodiment of the invention.

Referring now to FIG. 1, the prior art pinch off pliers 10 comprises a first clamping unit 100, second clamping unit 110 and an axil mechanism 120. The first clamping unit 100 comprises a first unit handle portion 102, a first unit medial portion 122, and a first unit front portion 104. A first unit clamp portion 106 is mechanically in communication with the first unit front portion 104. The second clamping unit 110 is made of a second unit handle portion 112, a second unit medial portion 124 and a second unit front portion 114. A second unit clamp portion 116 is mechanically in communication with the second unit front portion 114. The axial mechanism of the prior art comprises the first unit medial portion 122 and the second unit medial portion 124 mechanically in movable communication. The axial mechanism 120 provides for movement of the first clamping unit 100 and second clamping unit 110 to produce a pinching action. The prior art pinch-off pliers 10 follows along a first axis 140 for the length LP (146) of the prior art pinch-off pliers 10. In addition, the prior art pliers 10 follows along a second axis 142 for the length LP (146) of the prior art pinch-off pliers 10. The first axis 140 is parallel in orientation to the second axis 142 for the length LP (146) of the prior art pinch-off pliers 10. A canting angle theta 144, along the length LP (146) of the prior art pinch-off pliers 10, between the first axis 140 and the second axis 142 is equal to zero degrees. Thus, the prior art pliers 10 has a canting angle theta 144 of degrees along the length LP (146) of the prior art pliers 10. The prior art pliers 10 does not cant in orientation from the first axis 140 and the second axis 142 along the length LP (146) of the prior art pinch-off pliers 10. Therefore, the prior art pinch-off pliers possesses a linear orientation.

The linear orientation of the prior art pliers 10 provides for applications where open access to a flexible tube is available. However, the linear orientation of the prior art 10 becomes restrictive if not ineffective where the tube to be pinched is located in a confined space. In some orientations during use, the prior art pinch-off pliers 10 will not be able to effectively pinch the tube due to the location of the tube in a confined space and/or reach the flexible tube. Accordingly, the art of pinch-off pliers would benefit from are more reliably engaged pinch-off pliers which may be used for hose applications in confined spaces.

FIGS. 2-5 and 7 represent an embodiment of the pinch-off pliers 20 according to the present invention. The pinch-off pliers 20 comprise a first clamping unit 200, a second clamping unit 210, and an axial mechanism 220. The axial mechanism 220 separates a handle section 246 of the pinch-off pliers 20 and a clamping section 248 of the pinch-off pliers 20.

The first clamping unit 200 preferably comprises a first unit handle portion 202, a first unit front portion 204, a first unit clamp portion 206, and a first unit medial portion 208. The first clamping unit. 200 preferably has the first unit medial portion 208 between the first unit handle portion 202 and the first unit front portion 204. The first clamping unit is formed from at least one member, but preferably two members comprising a first member 312 and a second member 314. Preferably, the first member 312 incorporates the first unit handle portion 202 and a first member medial portion 242. Preferably, the second member 314 incorporates the first unit front portion 204, the first unit clamp portion 206, and a second member medial portion 244. The first member medial portion 242 and the second member medial portion 244 preferably are mechanically in movable communication to form the first unit medial portion 208.

The first unit handle portion 202 is preferably configured to be receivable within an operator's hand (not shown). The first unit handle portion 202 is preferably configured to be ergonomically formed to reduce user hand strain and fatigue. This can be accomplished by coating the first member handle portion 202 in a polymeric material as known in art and/or increasing the surface area in which the first unit handle portion 202 contacts a user's hand (not shown).

The second clamping unit 210 preferably comprises a second unit handle portion 212, a second unit medial portion 218, a second unit front portion 214, and a second unit clamp portion 216. The second clamping unit 210 preferably has the second unit medial portion 218 between the second unit handle portion 212 and a second unit front portion 214. The second clamping unit 210 is formed from at least one, preferably one member.

The second unit handle portion 212 is preferably configured to be received within an operator's hand (not shown). The second unit handle portion 212 is preferably configured to be ergonomically formed to reduce user hand strain and fatigue. This can be accomplished by coating the second unit handle portion 212 in a polymeric material as known in the art and/or increasing the surface area in which the second unit handle portion 212 contacts a user's hand (not shown).

The first clamping unit 200 and second clamping unit 210 are in mechanical communication at the axial mechanism 220. The axial mechanism 220 preferably comprises a first unit medial portion 208 in mechanical communication with a second unit medial portion 218. A first side 502 of the second unit medial portion 218 preferably is in mechanical communication with a second side 504 of the first unit medial portion 208 at the axial mechanism 220. An axis of rotation 226 preferably extends through the axial mechanism 220 between the first clamping unit 200 and the second clamping unit 210. The axis of rotation 226 is defined by an opening 227 (not shown) extending from the first side 506 of the first unit medial portion 208 to the second side 508 of the second unit medial portion 218. An axial pin assembly 320 preferably extends through the opening 227 (not shown) from the second side 508 of the second unit medial portion 218 and exiting the first side 506 of the first unit medial portion 208. The axial pin assembly 320 preferably comprises an axial pin 322 having a top side 323 extending from the first side 506 of the first unit medial portion 208. A portion of the axial pin 322 occupies the opening 227 (not shown) of the axial mechanism 220. A second end 404 of the axial pin assembly 320 is preferably in physical association with the second side 508 of the second unit medial portion 218. An axial washer 324 preferably encompasses the top side 323 of the axial pin 322 and is in physical association with the first side 506 of the first unit medial portion 208. Alternatively, the axial pin assembly 320 may extend beyond only one or none of the axial mechanism 220 sides, being the first side 506 of the first unit medial portion 208 or the second side 508 of the second unit medial portion 218. The axial mechanism 220 preferably provides for movement of the first clamping unit 200 and second clamping unit 210 to produce a pinching action.

The axial mechanism 220 preferably incorporates a locking pin assembly 330. The locking pin assembly 330 is defined by a locking pin channel 332 and locking pin assembly 330 traveling channels 402. A combination (not shown in the entirety) of the locking pin channel 332 and the locking pin assembly 330 traveling channels 402 extends from the first side 506 of the first unit medial portion 208 to the second side 508 of the second unit medial portion 218. The locking pin assembly 330 preferably extends through the combination (not shown in the entirety) of locking pin channel 332 and the locking pin assembly 330 traveling channels 402, extending through the first side 506 of the first unit medial portion 208 to beyond the second side 508 of the second unit medial portion 218. Alternatively, the locking pin assembly 330 may extend beyond only one side of the axial mechanism 220, being the first side 506 of the first unit medial portion 208 or the second side 508 of the second unit medial portion 218.

A first unit front portion 204 is preferably in fixed communication with the first unit medial portion 208 at a first unit intersection 340 along a first length $L_1$ (236) of the first clamping unit 200. The first unit intersection 340 preferably joins an anterior portion 342 of the first unit medial portion 208 and a posterior portion 344 of the first unit front portion 204. Alternatively, the first unit intersection 340 joins the first unit medial portion 208 and the first unit front portion 204 in various geometric orientations. The first unit front portion 204 preferably extends from the first unit intersection 340 ending at a first tip 222 of the first clamping unit 200. A first unit clamp portion 206 is in mechanical, preferably pivotal communication 302, with the first tip 222 of the first clamping unit 200. Alternatively, the first unit clamp portion 206 is in non-pivotal, mechanical communication with the first tip 222 of the first clamping unit 200. The first unit clamp portion 206 preferably extends a second length $L_2$ (308) along the first unit front portion 204. Alternatively, the first unit clamp portion 206 extends a second length $L_2$ (308) traversing the first unit front portion 204.

A second unit front portion 214 is preferably in fixed communication with the second unit medial portion 218 at a unit intersection 350 along a first length $L_1$ (236) of the second clamping unit 210. Alternatively, the second unit intersection 350 joins the second unit medial portion 218 and the second unit front portion 214 in various geometric orientations. The second unit intersection 350 preferably joins an anterior portion 352 of the second unit medial portion 218 and a posterior portion 354 of the second unit front portion 214. The second unit front portion 214 preferably extends from the second unit intersection 350 ending at a second tip 224 of the second clamping unit 210. The second unit clamp portion 216 is in mechanical, preferably pivotal communication 304, with the second tip 224 of the second clamping unit 210. Alternatively, the second unit clamp portion 216 is in non-pivotal, mechanical communication with the second tip 224 of the second clamping unit 210. The second unit clamp portion 216 extends a third length $L_3$ (310) along the second unit front portion 214. Alternatively, the second unit clamp portion 216 extends a third length $L_3$ (310) traversing the second unit front portion 214. The third length $L_3$ (310) of the second unit clamp portion 216 may be greater than, less than, or preferably equal to the second length $L_2$ (308) of the first unit clamp portion 206.

At least a portion of the first clamping unit 200 and at least a portion of the second clamping unit 210 follow along a first axis 228. Regarding the first clamping unit 200, a combination 408 of the first unit handle portion 202 and the first unit medial portion 208, up to and including the axis of rotation 226, may preferably follow along the first axis 228. Regarding the second clamping unit 210, a combination 410 of the second unit handle portion 212 and the second unit medial portion 218, up to and including the axis of rotation 226, may preferably follow along the first axis 228.

At least a portion of the first clamping unit 200 and at least a portion of the second clamping unit 210 following along a second axis 230. Regarding the first clamping unit 200, a combination 412 of the first unit medial portion 208 and first unit front portion 204, anterior to the axis of rotation 226, may preferably follow along the second axis 230. Regarding the second clamping unit 210, a combination 414 of the second unit medial portion 218 and second unit front portion 214, anterior to the axis of rotation 226, may preferably follow along the second axis 230.

An intersection 232 of the first axis 228 and the second axis 230 forming a canting angle theta 234. The canting angle theta 234 may be any angle greater than or less than zero degrees. Zero degrees for the canting angle theta 234 is defined as the canting angle theta 234 where the second axis 230 rests over or parallel to the first axis 228. Preferably the canting angle theta 234 extends towards the second unit handle portion 214. Alternatively, the canting angle theta 234 may extend towards the first unit handle portion 202. The canting angle theta 234 is greater than zero degrees. The canting angle 234 is positioned along a first length $L_1$ (236) of the pinch-off pliers 20. Preferably, the canting angle theta 234 may be positioned along the clamping section 248. Alternatively, the canting angle theta 234 may be positioned at any location along the first length $L_1$ (236) of the pinch-off pliers 20.

Referring to FIG. 2-6, in an alternative embodiment, the pinch-off pliers 20 is defined by the canting angle theta 234 in combination with a canting angle omega 610. A first plane 604 and a second plane 606 intersect, and arc perpendicular, along the second axis 230. The first axis 228 and the second axis 230 are contained in the first plane 604. At least a portion of the first clamping unit 200 and at least a portion of the second clamping unit 210 follow along the first plane 604. Regarding the first clamping unit 200, a combination 408 of the first unit handle portion 202 and the first unit medial portion 208, up to and including the axis of rotation 226, may preferably follow along the first plane 604. Regarding the second clamping unit 210, a combination 410 of the second unit handle portion 212 and the second unit medial portion 218, up to and including the axis of rotation 226, may preferably follow along the first plane 604.

A third axis 612 intersects the first axis 228 at an intersection 618 from the first side 614 of the first clamping unit 200 to the second side 616 of the second clamping unit 210. The third axis 612 being perpendicular to the first axis 228 and contained in the second plane 606. A fourth axis 608 intersects the first axis 228 and the second plane 606 at an intersection 620. At least a portion of the first clamping unit 200 and at least a portion of the second clamping unit 210 following along the fourth axis 608. Regarding the first clamping unit 200, a combination 412 of the first unit medial portion 208 and first unit front portion 204, anterior to the axis of rotation 226, may preferably follow along the fourth axis 608. Regarding the second clamping unit 210, a combination 414 of the second unit medial portion 218 and second unit front portion 214, anterior to the axis of rotation 226, may preferably follow along the fourth axis 608.

The intersection 620, is one in the same with the intersection 618 of the third axis 612 and the first axis 228, of the first axis 228, second plane 606 and the fourth axis 608 forming the canting angle theta 234. The canting angle theta 234 may be any angle greater than or less than zero degrees. Zero degrees for the canting angle dicta 234 is defined as the canting angle theta 234 where the fourth axis 608 is parallel to the first axis 228. Preferably the canting angle theta 234 extends towards the second unit handle portion 214. Alternatively, the canting angle theta 234 may extend towards the first unit handle portion 202. The canting angle theta 234 is greater than zero degrees. The clamping angle theta 234 is positioned along a first length $L_1$ (236) of the pinch-off pliers 20. Preferably, the canting angle theta 234 may be positioned along the clamping section 248. Alternatively, the canting angle theta 234 may be positioned at any location along the first length $L_1$ (236) of the pinch-off pliers 20.

A fifth axis 624 intersects, and is perpendicular to the first axis 228. The fifth axis 624 being contained by the first plane 604. A third plane 626 intersects the first plane 604 at the fifth axis 624 intersection 630. The fourth axis 608 being contained in the third plane 626. The intersection 630 of the first plane 604 and the third plane 626 forming the canting angle omega 610. The canting angle omega 610 may be any angle greater than, equal to, or less than zero degrees. Zero degrees for the canting angle omega 610 is defined as the canting angle omega 610 where the third plane 626 rests over or is parallel to the first plane 604. Preferably the canting angle omega 610 extends along the first plane 604. Alternatively, the canting angle omega 610 extends towards the first side 614 of the first clamping unit 200. Alternatively, the canting angle omega 610 extends towards the second side 616 of the second clamping unit 210. The canting angle omega 610 may be positioned along the first length $L_1$ (236) of the pinch-off pliers 20. Preferably, the canting angle omega 610 is positioned along the clamping section 248. Alternatively, the canting angle omega 610 may be positioned at any location along the first length $L_1$ (236) of the pinch-off pliers 20.

An open area 306 of the pinch-off pliers 20 is defined by the an area encompassed by at least one, preferably a portion of each, of the axial mechanism 220, the first unit front portion 204, the second unit front portion 214, the first unit clamp portion 206, and the second unit clamp portion 216. A section 420 of the axial mechanism 220 defines a first wall 422 nearest the axis of rotation 226 of the open area 306. An upper side 424 of the first unit front portion 204 defines a lower wall 426 of the open area 306. A lower side 428 of the second unit front portion 214 defines an upper wall 430 of the open area 306. A section 432 of the first unit clamp portion 206 defines all or a portion of a fourth wall 434 of the open area 306. A section 436 of the second unit clamp portion 216 defines all or a portion of a fourth wall 434 of the open area 306. Alternatively, the open area 306 may not be defined.

Figure 7:
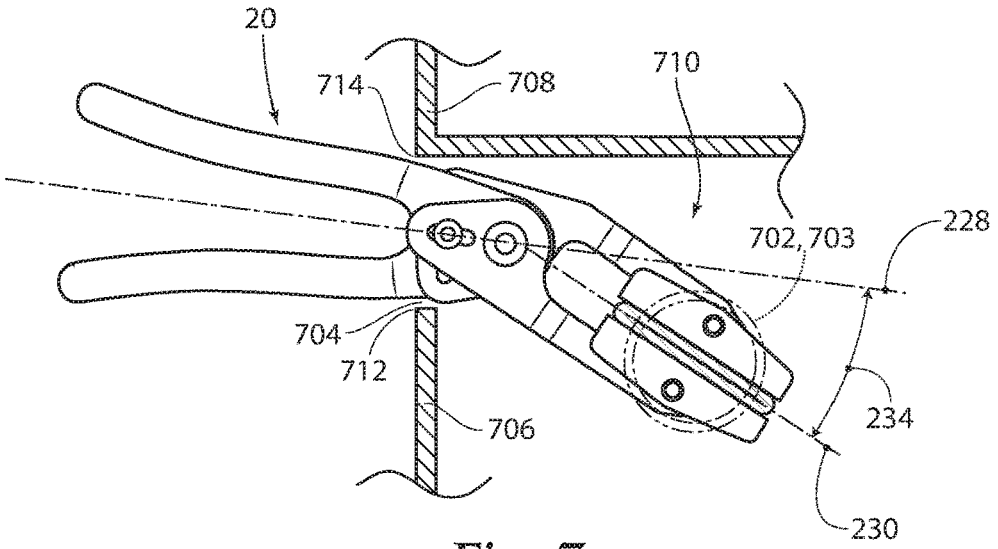
FIG. 7 is right side elevation view of the pinch-off pliers of the invention in use.

FIG. 7 illustrates the application of the pinch-off pliers 20. An open access 704 is defined by two barriers. A first barrier 706 defines a bottom 712 of the open access 704. A second barrier 708 defines a top of the open access 704. A cavity 710 exists beyond the open access 704. A hose 702 is positioned in the cavity 710 such that the prior art pinch-off pliers 10 could not be maneuvered to successfully contact the hose 702. In the current embodiment, as illustrated in FIG. 7, the pinch-off pliers 20 have been inserted into the open access 704 in the direction of the hose 702. The pinch-off pliers 20 possesses a canting angle theta 234, between the first axis 228 and the second axis 230, which is not equal to zero degrees. The pinch-off pliers 20 can be maneuvered to reach and effectively pinched the hose cross-section 703.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. A pinch-off pliers comprising:

a first clamping unit comprising a first unit handle portion pivotally coupled to a first unit front portion;

a second clamping unit having a second unit medial portion between a second unit handle portion and a second unit front portion;

the first clamping unit and second clamping unit in mechanical communication at an axial mechanism;

an axis of rotation extending through the axial mechanism between the first clamping unit and the second clamping unit;

the axial mechanism separating a handle section and a clamping section, said axial mechanism through said first unit handle portion, said first unit front portion and said second unit medial portion;

at least a portion of the first clamping unit and at least a portion of the second clamping unit following along a first axis, the first axis contained in a first plane;

at least a portion of the first clamping unit and at least a portion of the second clamping unit following along a second axis, the second axis contained in the first plane;

a third axis contained in a second plane intersects the first axis;

at least a portion of the first clamping unit and at least a portion of the second clamping unit following along a fourth axis, the fourth axis contained in a third plane;

an intersection of the first axis and the second axis anterior to the axis of rotation, forming a canting angle theta;

a line intersection of the first plane and third plane anterior to the axis of rotation forming a canting angle omega;

the line intersection forming the canting angle omega comprising the intersection forming the canting angle theta;

the canting angle theta and the canting angle omega greater than zero degrees positioned along the clamping section;

the canting angle theta and the canting angle omega initiated between said axis of rotation and at least one of a first tip of said jaw and a second tip of said jaw;

a locking assembly coupling said first clamping unit and said second clamping unit, said locking assembly comprising a pin, a first locking pin channel on said first handle portion and a second locking pin channel on said second handle portion, and a third locking pin channel on said first unit front portion, said pin carried by said first locking pin channel and said locking pin second channel, said pin carrying said first unit handle portion, said first unit front portion, and said second unit medial portion.

2. The pinch-off pliers of claim 1, wherein a first tip of the first clamping unit in mechanical communication with a first unit clamp portion.

3. The pinch-off pliers of claim 2, wherein the first tip of the first clamping unit in pivotal communication with the first unit clamp portion.

4. The pinch-off pliers of claim 1, wherein a second tip of the second clamping unit in mechanical communication with a second unit clamp portion.

5. The pinch-off pliers of claim 4, wherein the second tip of the second clamping unit in pivotal communication with the second unit clamp portion.

6. The pinch-off pliers of claim 1, wherein an open area is defined by the an area encompassed by at least one of the axial mechanism, the first unit front portion, the second unit front portion, the first unit clamp portion, and a second unit clamp portion.

7. The pinch-off pliers of claim 1, wherein the second unit clamp portion is defined by a third length greater than or equal to a second length of the first unit clamp portion.

* * * * *